United States Patent [19]

Brzoska

[11] Patent Number: 4,933,017

[45] Date of Patent: Jun. 12, 1990

[54] APPARATUS AND METHOD FOR OPENING DRAINS

[75] Inventor: Henry G. Brzoska, Stamford, Conn.

[73] Assignee: Lemaks Industries, Inc., Stamford, Conn.

[21] Appl. No.: 164,131

[22] Filed: Mar. 4, 1988

Related U.S. Application Data

[63] Continuation-in-part of Ser. No. 90,756, Aug. 28, 1987, abandoned.

[51] Int. Cl.[5] ..... A47L 5/14

[52] U.S. Cl. ..... 134/21; 15/330; 15/353; 15/406

[58] Field of Search ..... 15/330, 353, 345, 346, 15/406; 4/255, 256, 257; 134/21

[56] References Cited

U.S. PATENT DOCUMENTS

| | | | |
|---|---|---|---|
| 2,267,064 | 12/1941 | Wikelund | 4/255 |
| 3,238,556 | 3/1966 | Martin | 15/330 X |
| 4,055,405 | 10/1977 | Thun-Hohenstein | 15/353 X |
| 4,171,208 | 10/1979 | Lowder | 15/353 X |
| 4,674,137 | 6/1987 | Girse | 4/255 |

*Primary Examiner*—Chris K. Moore

*Attorney, Agent, or Firm*—Patrick J. Walsh

[57] ABSTRACT

The present invention discloses a method and apparatus for opening drains and the like, and includes a suitable vacuum/pressure source such as a household or industrial wet/dry vacuum cleaner with a control mechanism fitted to the vacuum cleaner or an intermediate receptacle for sequentially applying vacuum/pressure pulses to a clogged drain for loosening and purging the blockage occurring in the drain.

8 Claims, 8 Drawing Sheets

APPARATUS AND METHOD FOR OPENING DRAINS

BACKGROUND OF THE INVENTION

This is a continuation-in part of copending application Ser. No. 90,756, filed Aug. 28, 1987 entitled APPARATUS AND METHOD FOR OPENING DRAINS, now abandoned.

The present invention is directed to an apparatus and method for opening slow and clogged drains in commercial, industrial and household applications and for purging any type of radiator cooled engines such as cars, trucks, etc., and cooling systems for marine inboard and outboard motors.

It is a common problem that drains of various kinds such as household plumbing drains including bathtubs, showers, and so forth, periodically become clogged and need to be opened to restore normal usage. Typical methods for clearing drains call for the use of chemicals including caustics and acids which are highly detrimental to plumbing systems and plumbing fixtures. Chemical treatments tend to destroy metal fittings while caustics attack ABS pipes, and acids attack porcelain. These chemicals are dangerous to handle and are pollutants. In other techniques, high pressure drain opening systems tend to rupture plumbing joints and snakes tend to damage the finish of plumbing fittings and fixtures. Accordingly, there is need for a safe, nondestructive, nonpolluting way of dealing with clogged plumbing drains.

Motor vehicle radiators over a period of time accumulate rust scale and other deposits which impede cooling efficiency and require periodic flushing to remove accumulated materials and to restore the radiator to full heat exchange efficiency. Typically, high pressure devices or acids are used for cleaning automobile radiators and are detrimental to the structural integrity of the radiator.

Marine inboard and outboard motors ordinarily have cooling systems using ambient water and tend to become coated with foreign materials carried along in the cooling water. It is desirable periodically to flush the cooling systems to remove such materials which substantially interfere with heat transfer of the cooling system and also when winterizing an engine.

When winterizing swimming pools, the filter system is secured and it is desirable to purge the filter lines of water and debris which remain in the lines.

There is a need for an apparatus and method which can quickly and effectively deal with clogged drains and flushing radiator and cooling systems and aid in cleaning or winterizing swimming pools.

SUMMARY OF THE INVENTION

The present invention provides a method and apparatus for conveniently and effectively opening drains in plumbing systems which is applicable to other opening/flushing operations such as cleaning motor vehicle radiators and marine engine cooling systems. According to the invention, a series of pressure pulses both positive and negative are applied in rapid succession effectively to move and clear away debris blocking drains or to aid in purging and flushing cooling systems.

In one form of the invention the drain opener includes an ordinary household wet/dry vacuum cleaner fitted with a pressure reversing header for quickly applying a repetition of negative and positive pressure pulses to the plugged drain. The header includes a manually operable valve member which when manipulated causes the wet/dry vacuum cleaner to apply alternate pressure and vacuum pulses to the drain in rapid succession effectively to clear the drain. In a modification of the invention, pressurized water and/or detergent cleaners can aid in drain opening.

In another form of the invention, the drain opener is suitable for use with household canister-type dry vacuum or wet/dry vacuum cleaners having a vacuum port and an exhaust port. The drain opener includes a wet canister fitted with a pressure reversing header connected to a dry vacuum cleaner by suitable hose connections. In this form of the invention the household vacuum cleaner whether dry or wet/dry are used for supplying pressure and vacuum pulses while the wet canister serves as receptacle for effluent form clogged drains.

OBJECTS OF THE INVENTION

It is an object of the invention to provide a drain opener and method of operation for rapidly cleaning clogged drains, motor vehicle radiators, marine engine cooling systems and the like, and purging filter system lines when winterizing or cleaning swimming pools.

Another object of the invention is to provide a fitting for a typical wet/dry vacuum cleaner which effectively applies alternating pulses to open drains.

A further object of the invention is to provide differential pressure pulses of a low magnitude which will not overpressure and damage household plumbing fittings or engine cooling systems.

Another object of the invention is to provide a drain opener suitable for use with canister-type dry and wet/dry vacuum cleaners in which the effluent form a slow or clogged drain is collected in a separate receptacle.

A further object of the invention is to provide a drain opener which is safe to use, does not damage plumbing fittings and fixtures, and does not result in chemical pollution of plumbing systems, septic systems, underground sewers, and so forth.

Other and further objects of the invention will become apparent on an understanding of the following detailed description or will become apparent to one skilled in the art upon employment of the invention in practice.

Figure 1:
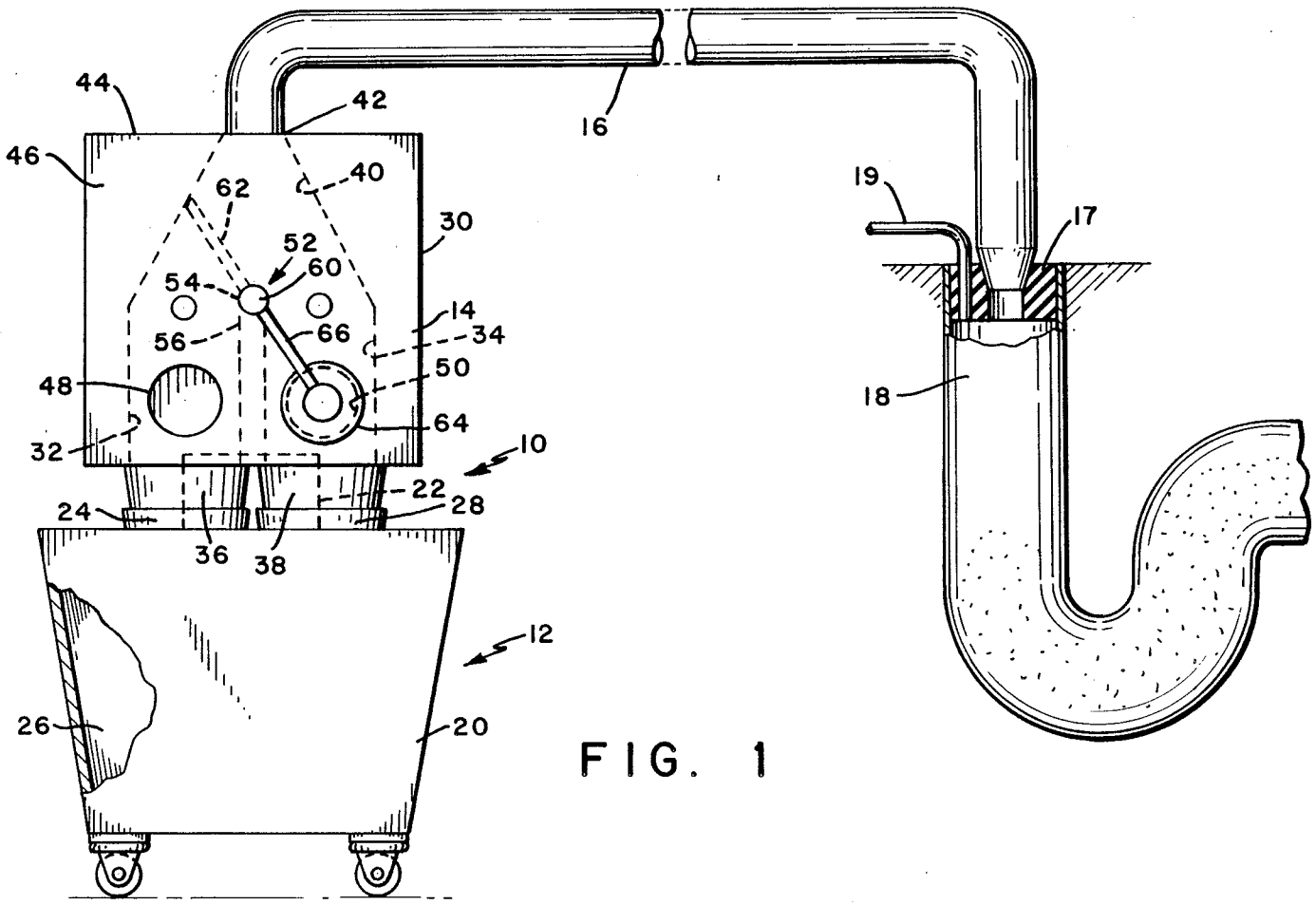
FIG. 1 is a schematic view of the apparatus for opening drains according to the present invention.

Referring to the drawing, a preferred embodiment of the apparatus 10 for opening drains includes a suitable pressure/vacuum source, as for example, a wet/dry vacuum cleaner 12, a pressure/vacuum control manifold 14, and an operating hose 16 for opening a drain 18.

The vacuum cleaner includes an upright receptacle 20 having a motor driven fan 22 for drawing vacuum through an inlet port 24 to the interior 26 of the receptacle or canister 20 and for exhausting air from the canister through an outlet port 28. In this description these ports are referred to as vacuum port 24 and pressure port 28.

The wet and dry vacuum cleaner operates in the usual fashion to draw debris into the canister through vacuum port 24 while exhausting or evacuating the interior of the canister through pressure port 28. This basic manner of operation applies with respect to the present invention. The pressure/vacuum control manifold regulates the drain opening apparatus so as selectively to apply pressure or vacuum through operating hose 16 to drain 18.

The control manifold 14 includes an upright block shaped housing 30 formed of any suitable material such as rigid plastic or cast aluminum. The manifold includes interior vacuum 32 and pressure 34 ducts and exterior conical vacuum 36 and pressure 38 sleeves for connection to the vacuum 24 and pressure 28 ports of the vacuum cleaner. The vacuum and pressure ducts merge into an upwardly extending two-way pressure/vacuum duct 40 with an access port 42 located in the top surface 44 of the manifold. The front wall 46 has openings 48, 50 communicating with the interior vacuum and pressure ducts respectively for the purpose of drawing air into or exhausting air from the canister during operation as more fully developed below.

The control manifold further includes a control mechanism 52 for directing pressure/vacuum flow within the operating hose 16. The control mechanism includes a pivot shaft 54 extending horizontally through the manifold and lying along the top of a partition 56 separating the interior vacuum 32 and pressure ducts 34. The shaft is pivotally mounted between the front 46 and rear 50 walls of the manifold and includes a projection 60 extending a short distance from the front wall.

A blade-shaped valve or damper 62 is supported by and projects radially from the surface of pivot shaft 54 for directing flow through two-way duct 40 and operating hose 16 by blocking either interior vacuum duct 32 or pressure duct 34. The contour of blade valve conforms to the interior wall surface of vacuum duct and pressure duct at their places of confluence with two-way duct in an air tight fit to avoid pressure loss during operation. The control mechanism further includes a movable cover 64 for selectively closing openings 48, 50 in front wall 46. The cover is connected to pivot shaft 54 by means of extension rod 66 for pivoting movement between the openings. A suitable knob 68 is fitted to the cover for ease of manipulating the cover. It is to be observed that blade valve 62 and extension rod 66 are coplanar so that when the blade valve covers the pressure duct 34, for example, the pressure opening 50 will be uncovered and vice-versa for vacuum duct 32 and vacuum opening 48.

Figure 2:
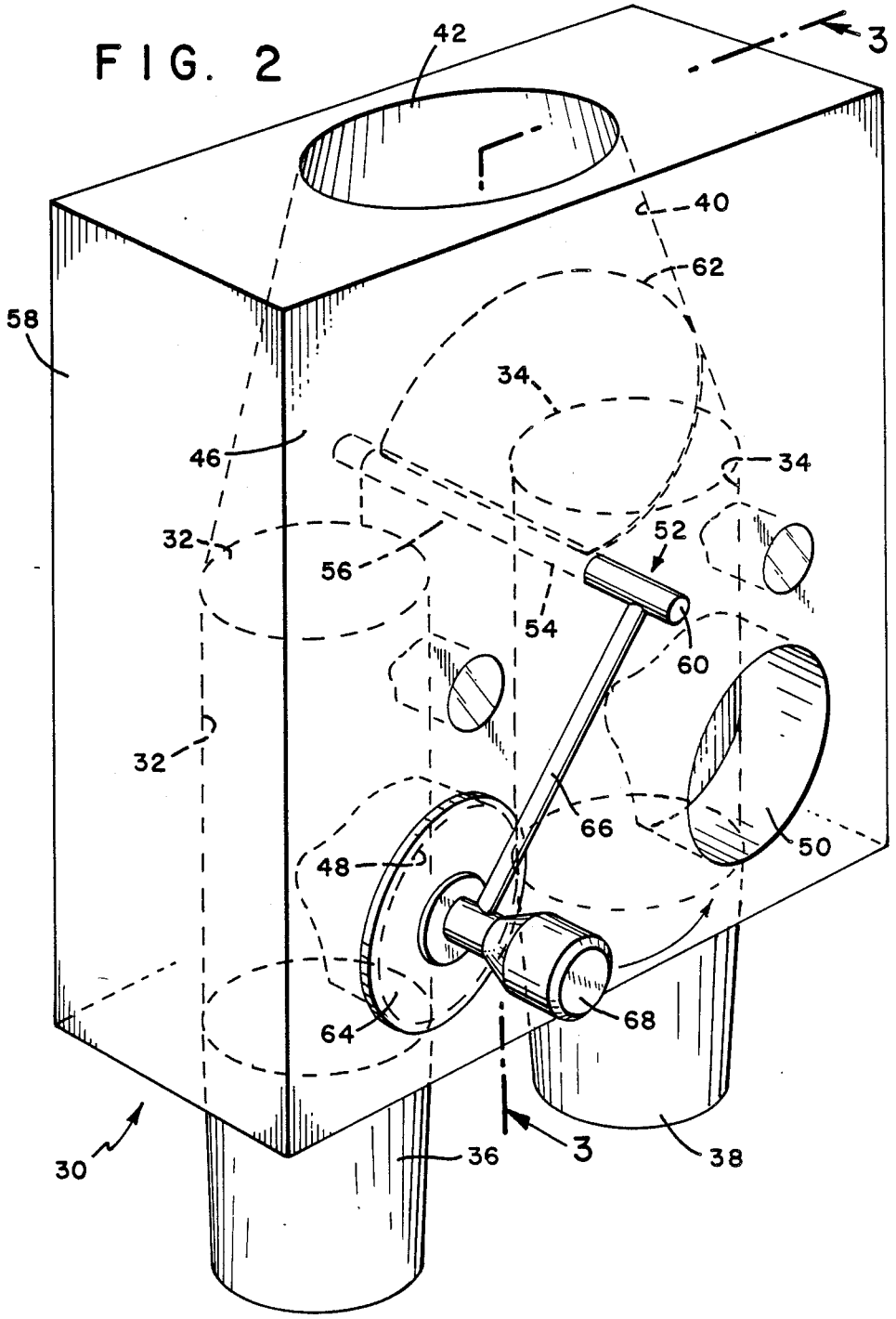
FIG. 2 is a perspective view of the pressure/vacuum control manifold according to the invention.
Figure 3:
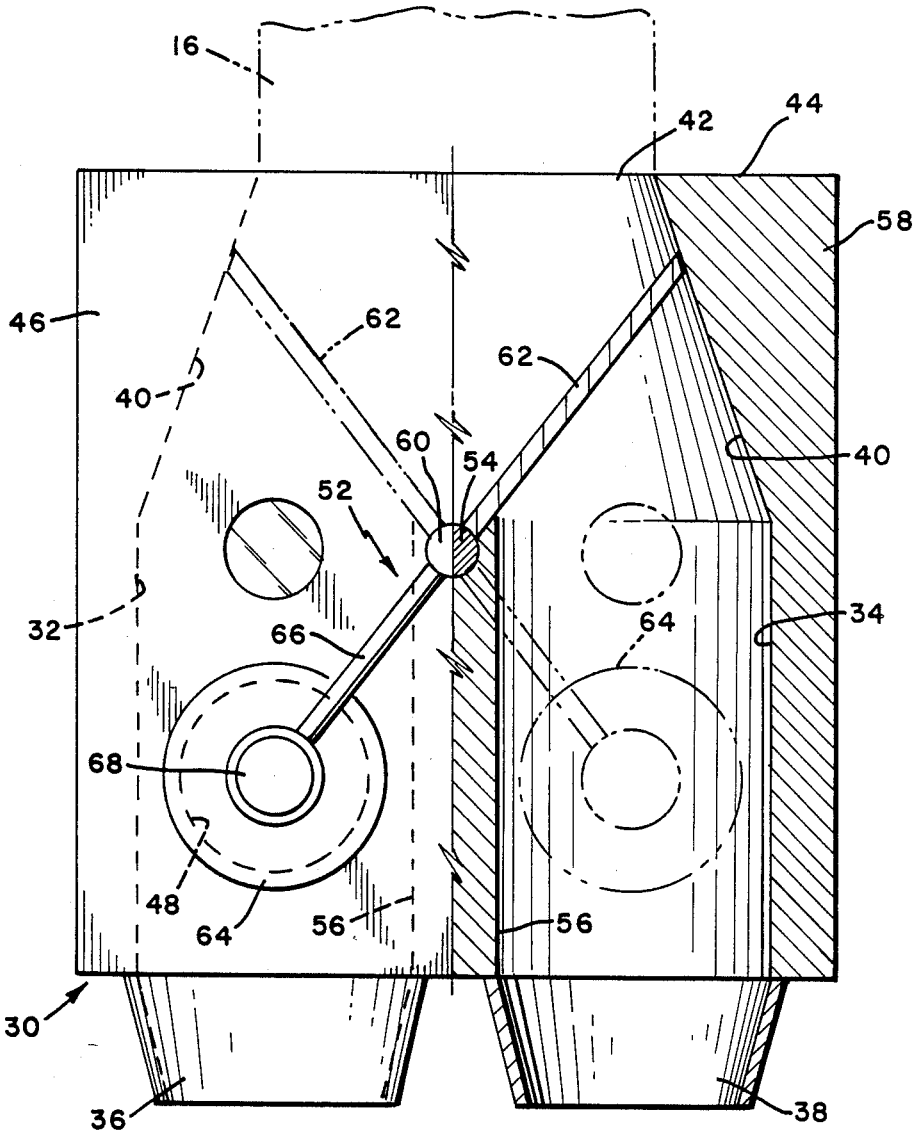
FIG. 3 is a section taken along line 3—3 of FIG. 2 to illustrate the interior of the control manifold.

In operation, the control mechanism is set in one position as for example, the solid line position of FIGS. 2 and 3 in which case exhaust air is expelled from the vacuum cleaner through the pressure duct 34 and pressure opening 50 while the external cover 64 closes vacuum opening 48 and opens vacuum duct 32 drawing air into the vacuum cleaner through hose 16. The position of valve 62 assures draw of partial vacuum through operational hose 16 and application of vacuum to the blocked drain. By reversing the position of the handle and control mechanism (to the dash line position of FIG. 3), pressure is now applied to the operating hose and drain. As shown in the dash line portion of FIG. 3, air is pushed into the operating hose through pressure duct 34 and into the drain while open vacuum port 48 provides for inflow of ambient air into the system.

By periodic manipulation of the control mechanism differential pressure pulsations are applied for effectively clearing the drain.

In like manner, the mechanism can be applied to other fittings such as automotive radiators, marine engines, and so on, for cleaning the fluid passages of such devices.

The invention is useful for cleaning or winterizing swimming pools particularly in purging water and any debris lodged in the filter recirculating and distribution lines.

Figure 4:
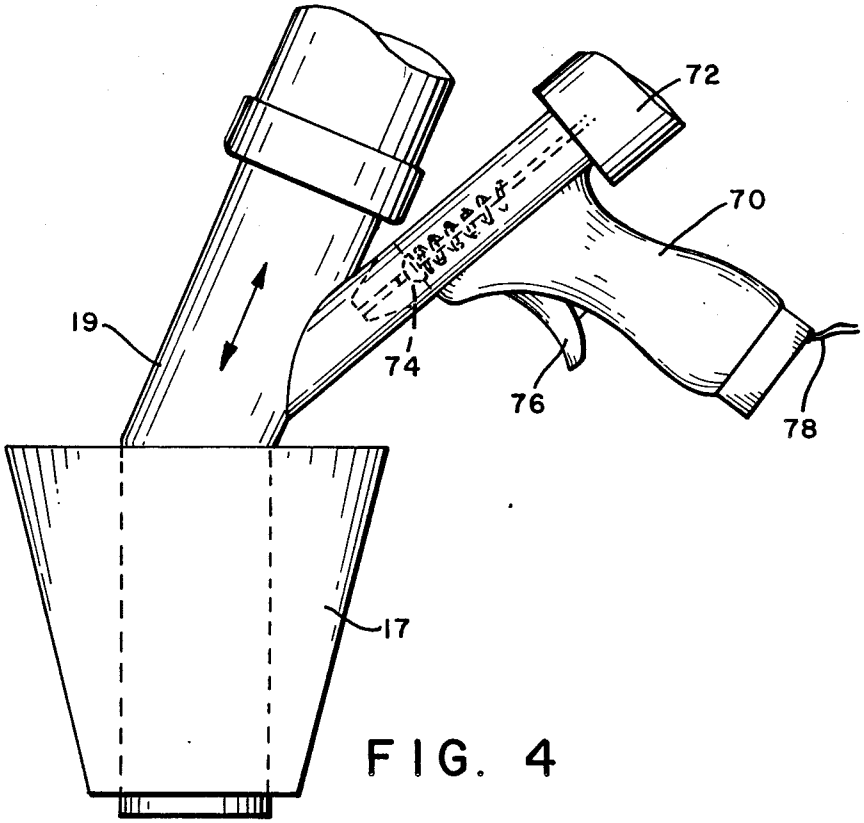
FIG. 4 is a schematic view of modification of the invention in which a water feed is applied together with positive pressure pulses to a drain.

If desired, auxiliary drain clearing aids such as detergent or pressurized water can be introduced through hose fitting 17 by means of an applicator 19 as shown in FIG. 1 and also in FIG. 4.

Figure 5:
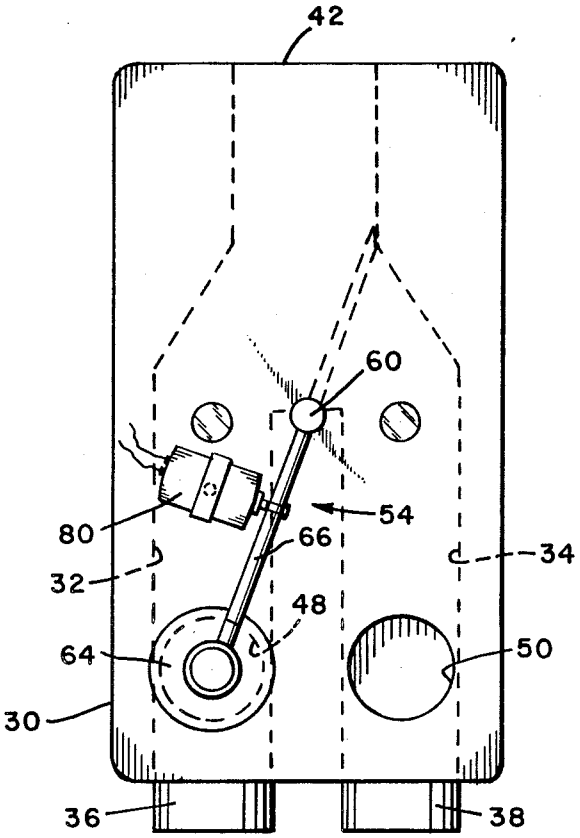
FIG. 5 is a schematic view of a modified control manifold according to the invention.

FIGS. 4 and 5 present a modification to the present invention in which water feed accompanies the positive pressure pulses of the system as an aid in opening drains and the like. Here a hand-held nozzle 70 is attached to hose fitting 17 and has a suitable fitting 72 for receiving a water supply hose. The nozzle includes a suitable valve 74 and is trigger actuated 76 for water supply. Additionally, the trigger forms part of an electric circuit 78 which also includes a control manifold solenoid 80 shown in FIG. 5. As the trigger is actuated water is applied to the drain and the solenoid-actuated movable cover 66 moved to the positive pressure mode. By releasing the trigger the water-feed is interrupted and a vacuum pulse applied to the drain. If desired, the nozzle may be used to feed detergents, degreasers, etc., to a drain.

Figure 6:
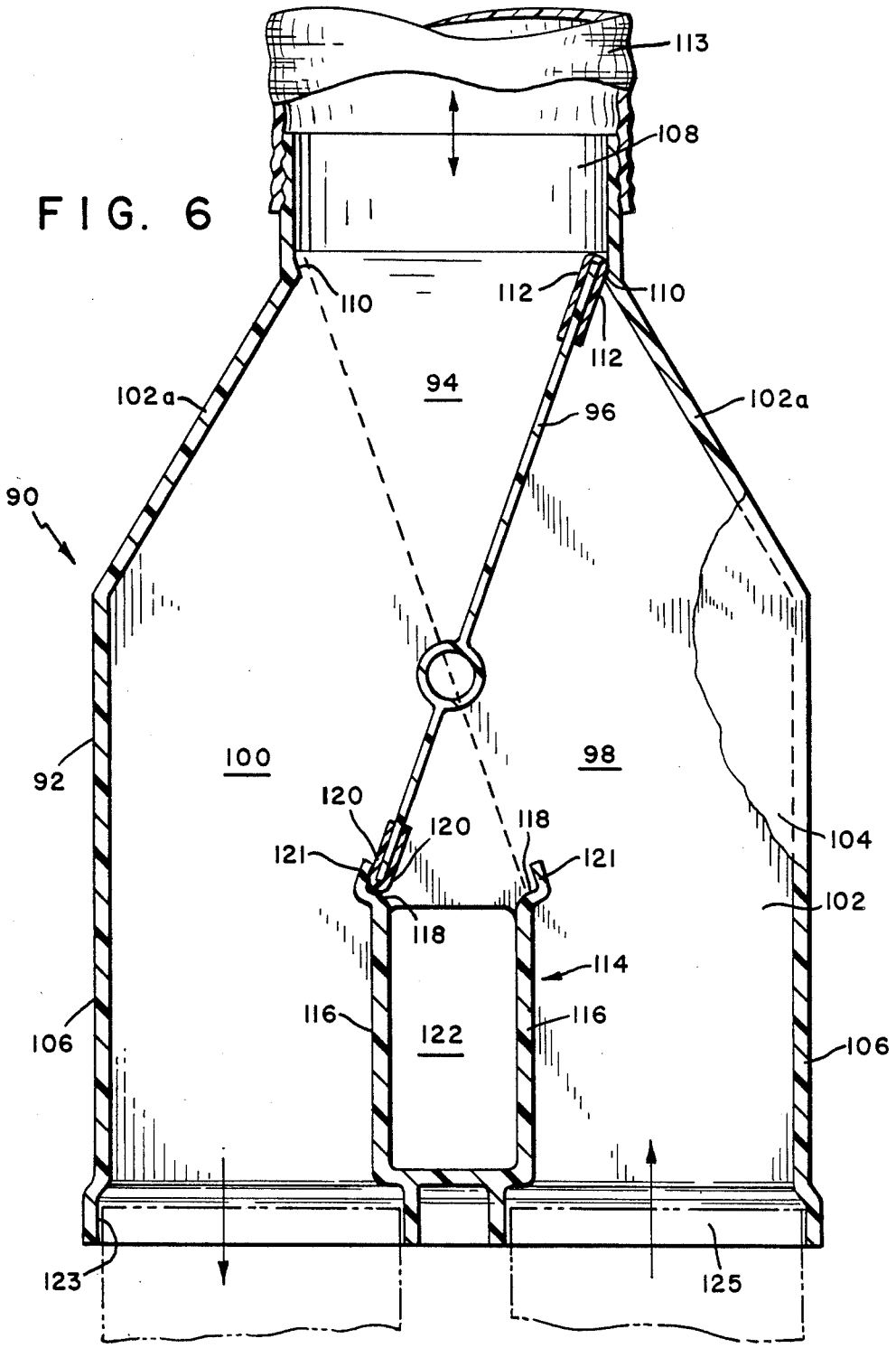
FIG. 6 is an elevational view in section of a further modification of the present invention.
Figure 7:
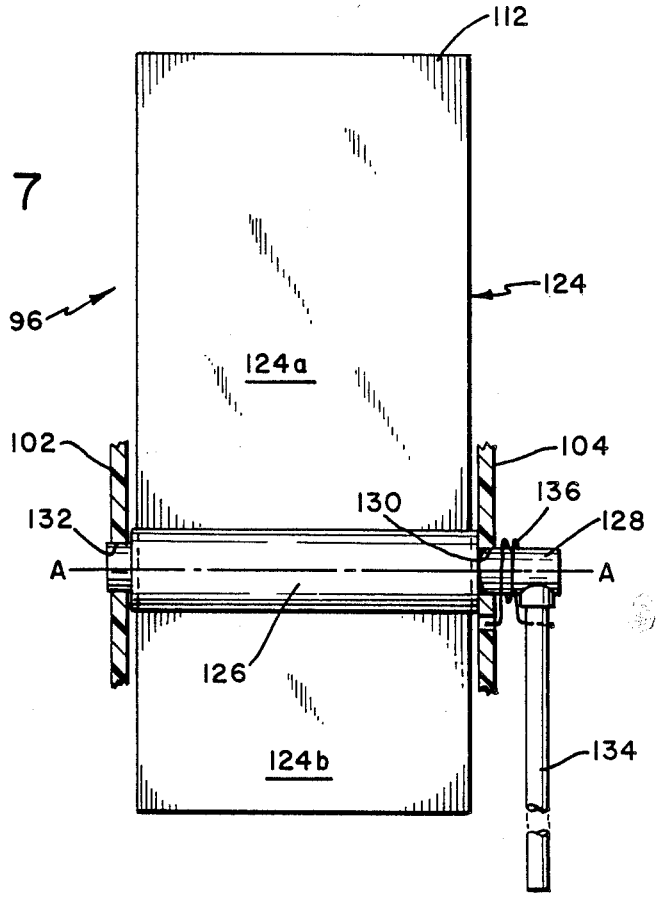
FIG. 7 is a side elevational view of a blade valve and handle forming part of the modified embodiment of FIG. 6.

A further modification of the invention is illustrated in FIGS. 6 and 7. The modified control manifold 90 includes an upright block-shaped housing 92 with an interior chamber 94 and a movable blade valve or damper 96 for directing pressure and vacuum pulses to a closed drain. The interior chamber includes a pressure chamber 98 through which pressurized air is applied to the drain or exhausted to atmosphere and a vacuum chamber 100 through which air is drawn from the drain or from atmosphere. The control manifold is generally rectangular in cross-section and includes rear 102, front 104 and side walls 106 of integral construction preferably of injection molded polypropylene. The side walls taper upwardly and inwardly at **102*a* from approximately two-thirds their vertical dimension terminating at a inlet/outlet sleeve 108. The upper portions of the front and rear walls are joined to and follow the contour of the tapered side wall portions 102*a*. The inner surface 110 of both tapered side walls just below inlet/outlet sleeve is beveled to form a sealing surface for engagement with the upper sealing surfaces 112 on both sides of the blade valve. An operating hose 113** fitted to the inlet/outlet sleeve communicates vacuum and pressure pulses to the drain.

The control manifold also includes an interior partition 114 comprising spaced partition walls 116 vertically oriented and extending between and attached to the front and rear walls. The interior partition is molded integral with the control manifold. The upper edges 118 of each partition wall are beveled to form a sealing surface for engaging the lower sealing surfaces 120 of the blade valve. Additionally, a stop shoulder 121 is located at the upper edge of each partition wall for limiting movement of the blade valve. The partition walls cooperate with the front wall and direct air into and out of a single inlet/outlet port 122 in the front wall.

The lower ends of the pressure and vacuum chambers have outlet 123 and inlet 125 ports, respectively, for connection to the corresponding ports of a vacuum cleaner substantially as shown in FIG. 1.

The generally rectangular blade valve shown in FIG. 7 comprises an imperforate valve plate 124 divided into major **124*a* and minor 124*b* parts along a pivot axis A—A defined by a hollow pivot hub 126. The pivot hub is generally cylindrical and is formed integral with the valve plate of suitable material such as polypropylene. The pivot hub receives a pivot shaft 128 which is assembled into the manifold at pivot openings 130, 132 located in front 104 and rear walls 102. A handle member 134** is fitted to the front end of the pivot shaft for manipulating the blade between vacuum and pressure positions.

As shown in FIG. 6, the control manifold has its blade valve closing the pressure chamber so that in operation the vacuum cleaner applies a vacuum pulse to the closed drain through inlet sleeve 108 and operating hose 113. Pressurized air from the vacuum cleaner enters the pressure chamber and is exhausted through outlet port 122. By reversing the valve position to the dash line position of FIG. 6, a pressure pulse is applied to the closed drain through outlet sleeve 108 and ambient air is drawn through the inlet port 122 into the vacuum chamber providing the source of pressurized air to the closed drain through operating hose 113.

The blade valve includes a spring member 136 (FIG. 7) fitted between the pivot shaft and front wall for resisting the tendency of the blade valve to shift (FIG. 6) under the influence of a pressure differential acting on the blade valve in the vacuum mode (solid line position of FIG. 6). Alternatively, a ball/detente arrangement between front wall 104 and the operating handle 134 may be used to provide positive positioning and holding of the blade valve in both pressure and vacuum positions.

Figure 9:
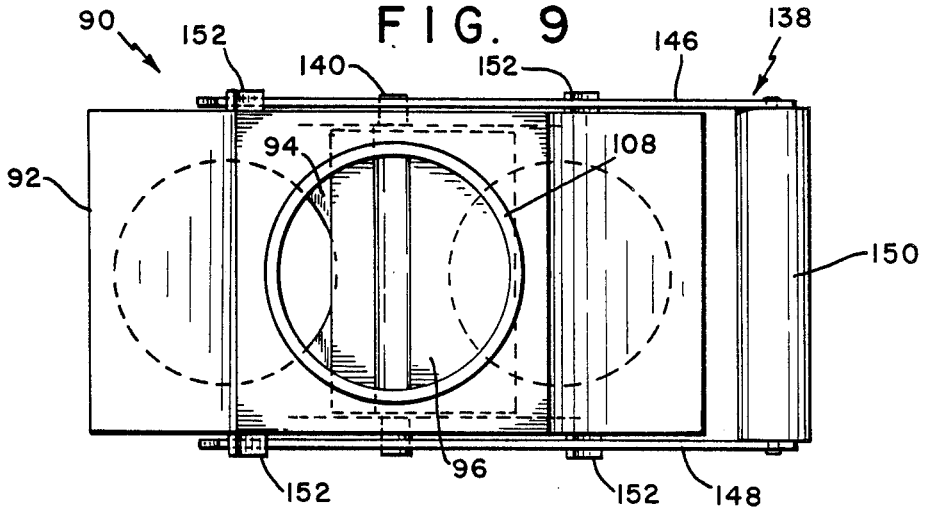
FIG. 9 is a top plan view of the manifold of FIG. 8.
Figure 8:
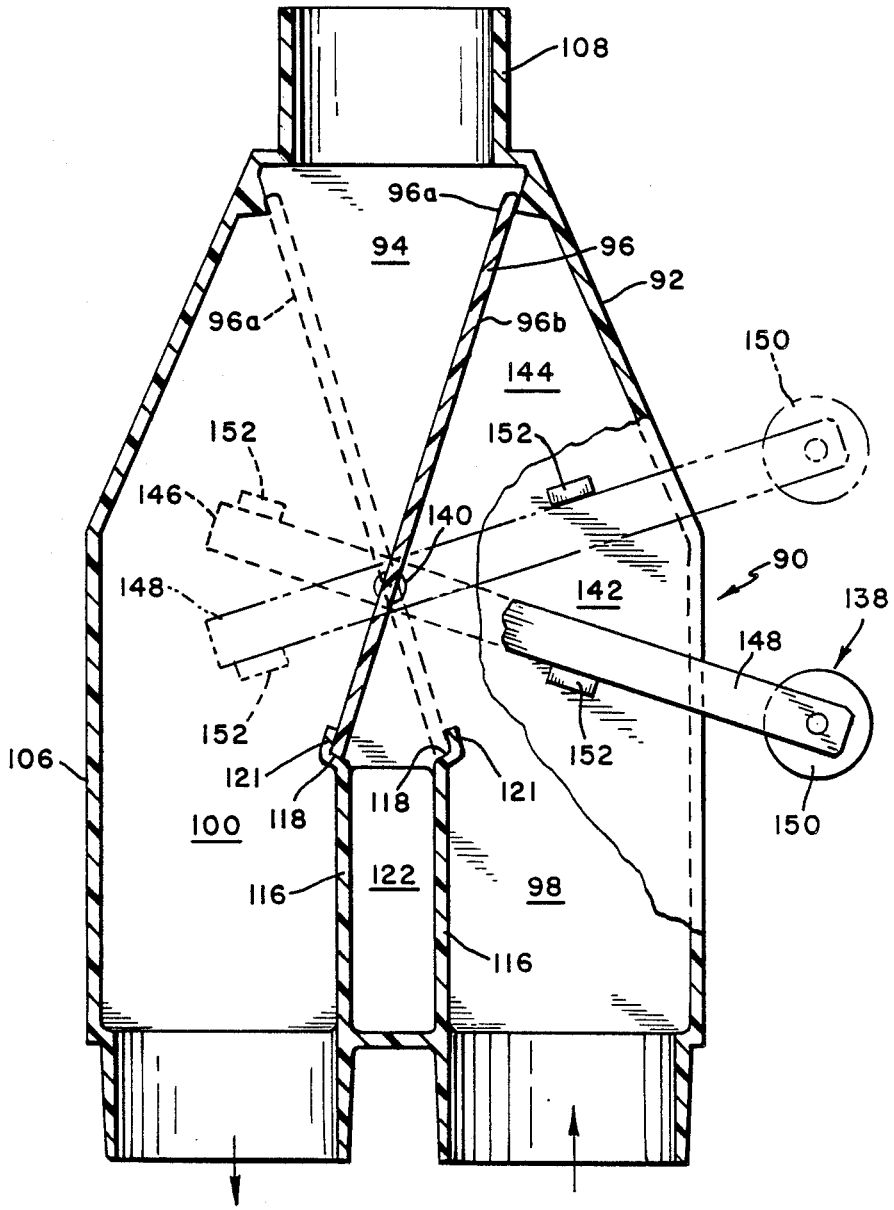
FIG. 8 is a side elevational view of a further modification of the invention showing the pressure/vacuum control manifold with a modified operating handle.

FIGS. 8 and 9 illustrate a modification of the pressure/vacuum manifold of FIG. 6. This form of the manifold 90 includes housing 92, interior chamber 94 and damper 96 for directing pressure and vacuum pulses to a closed drain. The damper 96 is manipulated between vacuum (full line) and pressure dash line) positions by means of operating handle 138. A pivot shaft 140 is mounted between front 142 and rear 144 walls and receives damper 96 in the manner of FIGS. 6 and 7. First and second levers 146, 148 are fitted to the ends of the pivot shaft extending along the front and rear walls and are joined at one end by a laterally extending gripping handle 150. The other ends of the levers extend away from the pivot shaft to provide balance to the operating handle. The outer surfaces of the front and rear walls are provided with abutments or stop members 152 which limit the movement of the operating handle without stressing the blade valve. The stop members 152 are conveniently molded integral to the front and rear walls. The operating handle is weighted for the purpose of counteracting the tendency of the blade valve 96 to move counterclockwise (FIG. 8) by reason of the pressure differential on the vacuum **96*a* face and pressure face 96*b*. The same pressure differential is sufficient to hold the operating handle in the pressure mode (dash lines FIG. 8). The handle itself provides a convenient and durable structure for rapidly switching the unit from pressure to vacuum modes. The other structural elements of FIGS. 8 and 9 have numerals corresponding to the same structural elements of FIG. 6**.

Figure 10:
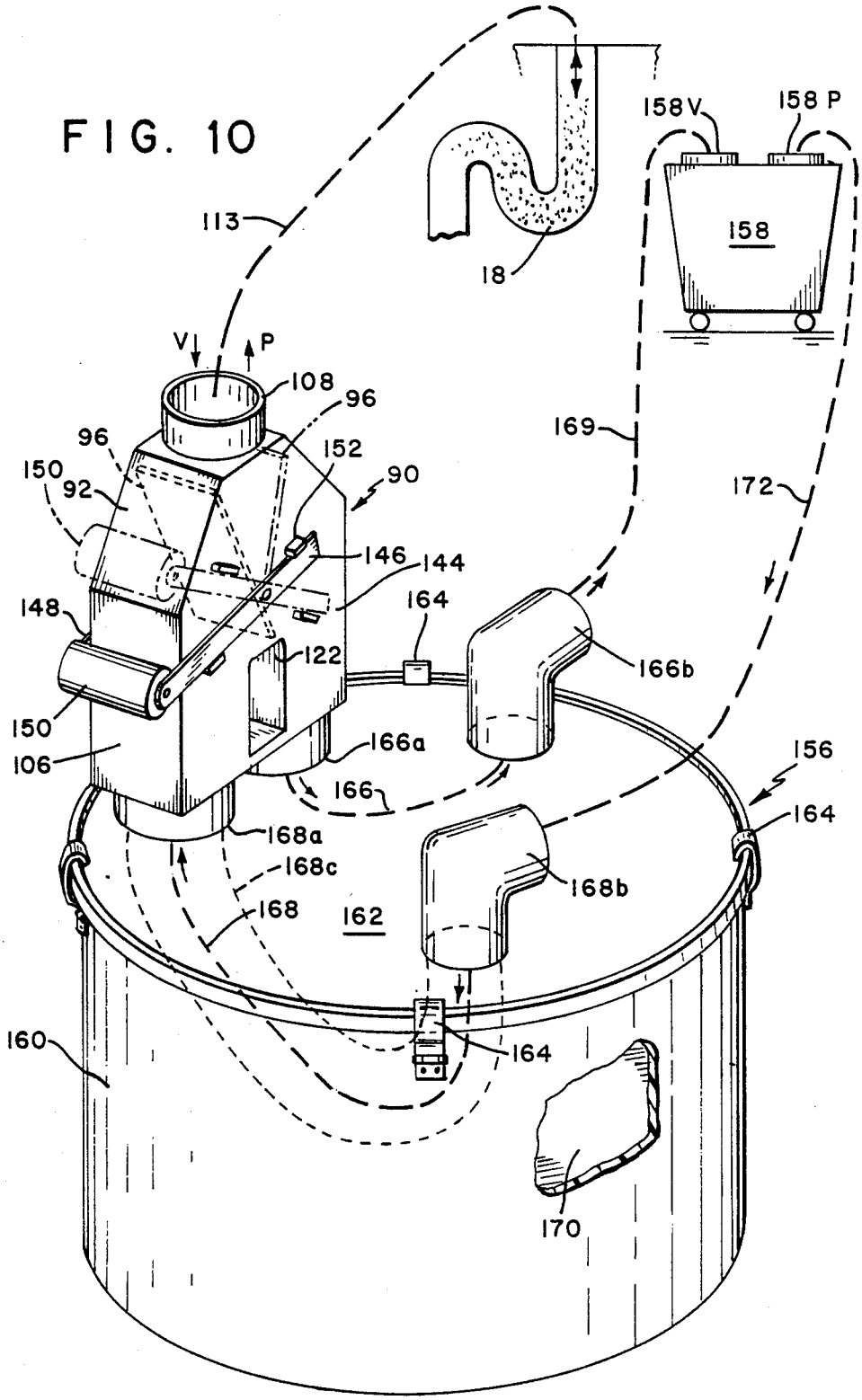
FIG. 10 is a further modification of the invention illustrating a drain opener including a pressure/vacuum control manifold and receptacle for connection to a canister-type dry or wet/dry vacuum cleaner.

FIG. 10 is a further modification of the invention illustrating a drain opener including a pressure/vacuum control manifold and receptacle for connection to a canister-type dry or wet/dry vacuum cleaner.

The drain opener includes a dedicated intermediate canister or receptacle 156 for receiving effluent from a plumbing drain 18, pressure/vacuum control manifold 90, and a canister-type dry or wet/dry vacuum cleaner 158. The arrangement provides for communication of pressure/vacuum pulses to plumbing drain 18 from pressure/vacuum source such as the canister-type vacuum cleaner 158 without requiring to the source vacuum cleaner to receive effluent from the plumbing drain. The effluent is received and retained by the intermediate canister 156. This modification includes a pressure/vacuum control manifold 90 as described above for FIGS. 8 and 9 as reflected by corresponding reference numerals of FIG. 10. As described above, the pressure/-vacuum manifold 90 directs pressure or vacuum pulses through hose 113 to plugged plumbing drain 18.

The intermediate canister includes a bucket 160 of suitable capacity, e.g., five gallons, and tightly fitting top cover 162 held in place by several snap fittings 164. The top cover includes fittings defining a vacuum line 166 and a pressure line 168.

The vacuum line 166 includes a circular port **166*a* in the top surface of the cover and an upwardly directed elbow fitting 166*b* for connection to the vacuum port 158 of vacuum cleaner through a suitable hose 168. Both circular port 166*a* vacuum elbow 166*b* are open to the interior 170** of the bucket.

The pressure line 168 also includes a circular port **168*a* and an upwardly directed elbow 168*b* similar to the vacuum line fittings, however, the pressure line further includes a conduit connection 168*c* directly between pressure elbow and pressure port so that pressure pulses are sent from pressure source 158*p* through hose 172, pressure line 168, manifold 90 to plumbing drain via hose 113**. In other words, the interior of the bucket is not subjected to pressure pulses.

In operating the embodiment of FIG. 10, the operating handle 150 is set in vacuum mode (solid lines) and a vacuum pulse drawn on clogged drain by vacuum source **158*v*. The bucket interior 170 is subject to vacuum conditions developed by the vacuum source. Effluent drawn from the drain in this operating mode is trapped in the bucket. By merely reversing the operating handle to pressure mode (dash lines) a pressure pulse is directed from pressure source through pressure line, manifold, hose 113**, to drain. When the drain is clear, effluent in canister can be disposed of by removing the top cover.

The present invention has been described with particular reference to utilizing a household wet/dry vacuum cleaner in usual commercial form. It is within the purview of the present invention to provide apparatus for opening drains specifically built for the purpose as would be used for commercial or industrial applications in which the pressure/vacuum source together with the control mechanism are dedicated to drain opening applications and are of unitary construction. In each embodiment of the invention, a drive motor of greater horsepower is used to achieve higher levels of pressure/vacuum than are available with wet/dry vacuum cleaners and which are appropriate and required for clearing drains in commercial and industrial applications. Similarly, the present invention contemplates embodiments of the invention specifically designed for use in purging motor vehicle radiators, the cooling systems of marine engines, and so forth where pressure/vacuum levels are tailored specifically for these applications.

I claim:

1. An apparatus for opening drains comprising a pressure source and a vacuum source, a control manifold connected to the pressure and vacuum sources, the control manifold having an interior chamber divided into a vacuum chamber and a pressure chamber, a pair of spaced partition walls located between the vacuum chamber and the pressure chamber, the partition walls cooperating with a valve member for defining the vacuum chamber and the pressure chamber, a port to atmosphere from the interior chamber located in the space between partition walls, the manifold having an inlet/-outlet port for connection to an operating hose connected to a plugged drain, means for moving the valve between first and second positions to connect sequentially the pressure source and the vacuum source to the drain and in the same sequence to connect the pressure chamber and the vacuum chamber to the port to atmosphere.

2. An apparatus as defined in claim 1 in which the valve moving means includes an external handle biased to overcome a pressure differential between pressure and vacuum sides of the valve when the control manifold is in vacuum mode.

3. An apparatus as defined in claim 2 in which the external handle is weight biased and the control manifold has means for stopping the handle at pressure mode and vacuum mode positions.

4. An apparatus for opening drains comprising a vacuum cleaner providing a pressure source and a vacuum source, an intermediate canister having a removable top cover tightly fitted to a bucket for receiving effluent from a drain, the top cover having fittings defining a vacuum line and a pressure line with the vacuum line communicating with the interior of the bucket and the pressure line having a by-pass conduit through the interior of the bucket, flexible hoses for connecting the vacuum line and the pressure line respectively to the vacuum and pressure sources, a control manifold connected to the pressure and vacuum lines, the control manifold having an interior chamber divided into a vacuum chamber and a pressure chamber, a valve member defining the vacuum chamber and a pressure chamber, the manifold having an inlet/outlet port for connection to an operating hose connected to a plugged drain, means for moving the valve between first and second positions to connect sequentially the pressure source and the vacuum source to the drain, and said intermediate canister for receiving effluent when the drain is connected to the vacuum source.

5. A method for opening plugged drains and the like including the steps of establishing continuous sources of pressure and of vacuum, connecting the plugged drain to the source of pressure and to the source of vacuum through a two-way chamber, and alternately applying pressure and vacuum through the two-way chamber to the drain for dislodging and purging the blockage, and providing a receptacle for receiving effluent from the drain through the vacuum connection.

6. A method as set forth in claim 5 includes the step of supplying a detergent under pressure to the drain during the pressure step.

7. An apparatus for opening drains comprising a pressure source and a vacuum source, a control manifold connected to the pressure and vacuum sources, the control manifold having an interior chamber divided into a vacuum chamber and a pressure chamber, partition means located between the vacuum chamber and the pressure chamber, a valve member cooperating with the partition means for defining the vacuum chamber and the pressure chamber, means for porting the pressure chamber and the vacuum chamber to atmosphere, the manifold having an inlet/outlet port for connection to an operating hose connected to a plugged drain, means for moving the valve between first and second positions to connect sequentially the pressure source and the vacuum source to the drain and in the same sequence to connect the vacuum chamber and the pressure chamber to the porting means.

8. An apparatus as defined in claim 7 which further includes means for applying a positive pressure water feed to the drain, and means for simultaneously applying positive air pressure to the drain together with the water feed.

* * * * *